United States Patent [19]

Thompson

[11] Patent Number: 4,523,890

[45] Date of Patent: Jun. 18, 1985

[54] END SEAL FOR TURBINE BLADE BASE

[75] Inventor: Douglas K. Thompson, Speedway, Ind.

[73] Assignee: General Motors Corporation, Detroit, Mich.

[21] Appl. No.: 543,492

[22] Filed: Oct. 19, 1983

[51] Int. Cl.[3] ..... F01D 5/08; F01D 5/30

[52] U.S. Cl. ..... 416/95; 416/193 A; 416/221

[58] Field of Search ..... 416/90 R, 92, 95, 135, 416/137, 193 R, 193 A, 219 R, 220 R, 220 A, 221

[56] References Cited

U.S. PATENT DOCUMENTS

| | | | |
|---|---|---|---|
| 3,490,852 | 1/1970 | Carlstrom et al. . | |
| 3,572,966 | 3/1971 | Borden et al. . | |
| 3,689,177 | 9/1972 | Klassen | 416/220 |
| 3,853,425 | 12/1974 | Scalzo et al. . | |
| 3,957,393 | 5/1976 | Bandurick . | |
| 4,021,138 | 5/1976 | Scalzo et al. . | |

*Primary Examiner*—Robert E. Garrett

*Assistant Examiner*—A. M. Bradley

*Attorney, Agent, or Firm*—Saul Schwartz

[57] ABSTRACT

An end seal for root manifolds at the bases of air cooled turbine blades disposed in retention slots in a turbine wheel; the end seal including an annular groove in the upstream face of the wheel having an outboard cylindrical edge outboard of the root manifold, an inboard cylindrical edge inboard of the retention slots and a slot face parallel to the upstream face of the wheel; an imperforate seal ring in the annular groove with a right circular flange adjacent the outboard edge, an annular foot engaging the groove slot face inboard of the retention slots, and a body portion defining an accordion fold in transverse cross section; and seal plate segments on the wheel over the groove. The seal plate segments capture the seal ring and bias the foot against the wheel while centrifugal forces are developed during wheel rotation to thrust the cylindrical flange against the groove outboard edge for outboard sealing and to urge the accordion fold to a folded condition for more tightly thrusting the foot against the groove slot face for inboard sealing.

3 Claims, 3 Drawing Figures

END SEAL FOR TURBINE BLADE BASE

BACKGROUND OF THE INVENTION

1. Field of the Invention

This invention relates generally to gas turbine engine rotors having air cooled turbine blades and, more particularly, to end seals at the turbine blade bases.

2. Description of the Prior Art

With more emphasis on fuel economy and more extensive use of air cooled turbine blades, minimizing the loss of cooling air from blade delivery circuits is an important design consideration. One very difficult area to seal is the turbine blade-turbine wheel attachment interface. Typically, cooling air is directed into clearance slots or root manifolds in the wheel inboard of the individual blade attachments from which it flows into the internal cooling cavities of the blades. The typical fir tree attachment on each blade base fits snugly into corresponding wheel lugs and under centrifugal loading seals tightly against leakage across the width of the wheel. However, due to manufacturing tolerances the lengths of the blade bases and the width of the wheel may differ from blade to blade and wheel to wheel. The result is leakage at the ends of the root manifolds between the blades or wheel and cover plates normally installed to prevent such leakage. An end seal according to this invention reduces cooling air loss usually attributable to manufacturing tolerances between blade bases and the turbine wheel.

SUMMARY OF THE INVENTION

Accordingly, the primary feature of this invention is that it provides a new and improved end seal at the bases of air cooled turbine blades which minimizes cooling air leakage otherwise resulting primarily from manufacturing tolerance related differences between lengths of the turbine blade bases and width of the turbine wheel. Another feature of this invention resides in the provision in the new and improved end seal of a seal ring in an annular groove in one face of the turbine wheel traversing each of the blade bases and spanning the root manifolds, the ring having a right circular flange adjacent a radially outboard edge of the groove for centrifugally sealing thereagainst and an annular foot biased against the slot face of the groove and effecting circular line contact therewith radially inboard of the root manifolds for inboard sealing. Still another feature of this invention resides in the provision in the new and improved end seal of a seal ring wherein the annular foot is connected to the right circular flange through an intermediate annular body portion defining an accordion fold and in the provision of a plurality of end plates on the wheel covering the groove, the end plates capturing the seal ring in the groove and engaging the intermediate body portion of the ring to flex the accordion fold toward a flattened condition and thereby bias the annular foot against the slot face of the groove. Yet another feature of this invention resides in the provision in the new and improved end seal of an accordion fold in the seal ring which is centrifugally thrust toward a fully folded condition during rotation of the turbine wheel to even more forcefully urge the foot against the groove slot face for sealing inboard of the root manifolds. These and other features of this invention will be readily apparent from the following specification and from the drawings wherein:

Figure 1:
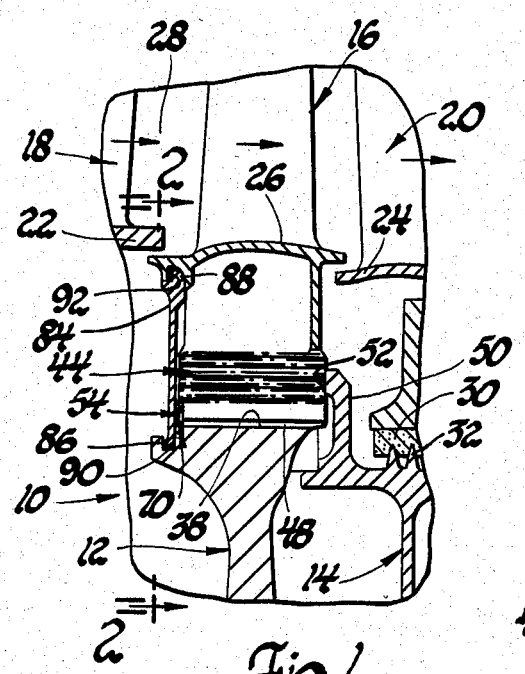
FIG. 1 is a fragmentary elevational view partly in section of a gas turbine rotor including air cooled turbine blades and an end seal according to this invention.

Referring now to FIG. 1 of the drawings, a rotor 10 of a gas turbine engine includes a turbine wheel 12 and a spacer 14, the turbine wheel and the spacer being clamped together by conventional means, not shown, on the rotor. The turbine wheel 12 carries a plurality of air cooled turbine blades forming one stage of turbine blades of the engine, only a representative turbine blade 16 being illustrated in the Figures, which stage of blades is disposed between a stationary array of vanes forming a nozzle 18 upstream of the stage and a stationary array of vanes forming a stator 20 downstream of the stage. The nozzle 18 is mounted on a casing, not shown, of the engine and directs motive fluid at the turbine blades. The stator 20 is similarly mounted on the casing of the engine and directs motive fluid from the turbine blades to the next succeeding stage of turbine blades, not shown. Each of the vanes of the nozzle 18 has a platform 22 which cooperates with a similar platform 24 on each of the vanes of the stator 20 and with similar platforms on the turbine blades, as for example a platform 26 on the representative turbine blade 16, in defining a motive fluid path 28. An abradable seal 30 on the stator 20 cooperates with a plurality of circumferential ridges 32 on the spacer 14 in defining a seal between the turbine blade stage represented by blade 16 and the next succeeding turbine blade stage, not shown.

Referring again to FIGS. 1 and 2, the turbine wheel 12 has an annular upstream face 34 in a transverse plane perpendicular to the axis of rotation of the rotor, an annular downstream face in a similar transverse plane, and a plurality of circumferentially spaced blade retention slots or cavities, as for example a representative slot 38, FIG. 2, oriented generally axially between the upstream and downstream faces. Describing only the representative slot 38, the latter is of well known fir tree configuration and includes a radially innermost extremity or bottom 39 and a plurality of axially extending wheel lugs 40, 40' and 40'' arranged in pairs on opposite sides of the slot which becomes progressively narrower in the radial inward direction. The wheel lugs receive therebetween a corresponding plurality of blade lugs 42, 42' and 42'', respectively, on a fir tree base 44 of the representative turbine blade 16, the base 44 having a lower extremity or bottom 45 and being slidably inserted into the retention slot 38 through either of the upstream or downstream faces.

Figure 2:
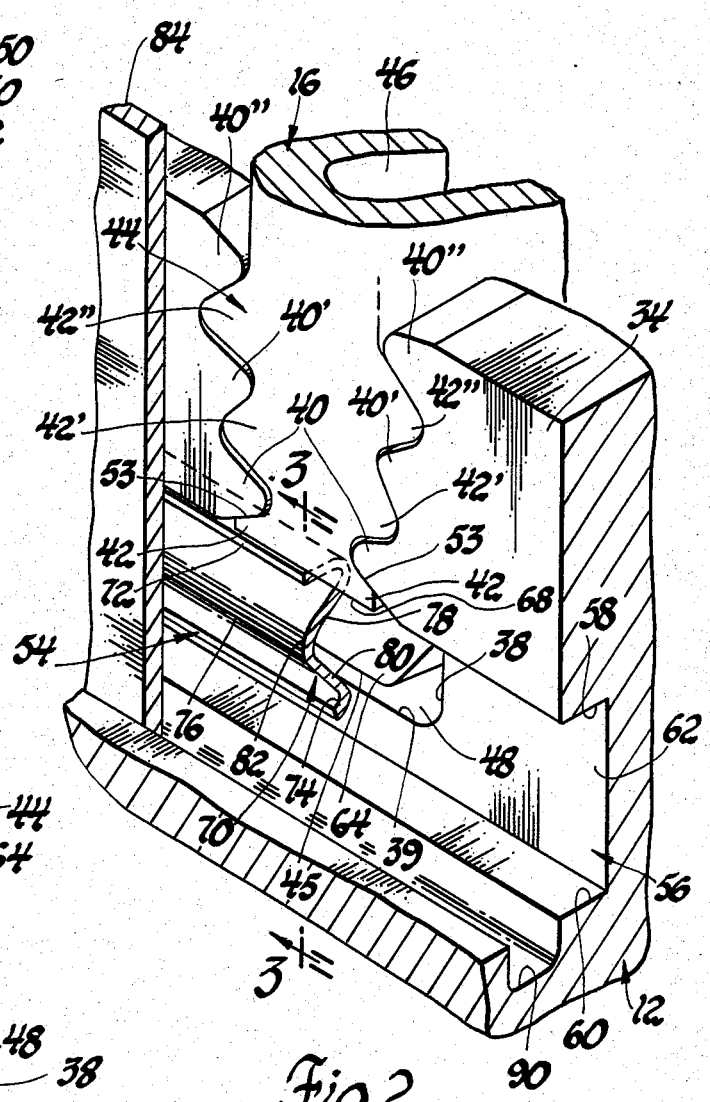
FIG. 2 is an enlarged perspective view taken generally along the plane indicated by lines 2—2 in FIG. 1.

The representative turbine blade 16 is air cooled and includes a schematically illustrated internal passage 46, FIG. 2, which communicates with the motive fluid path 28 and a space 48 between the bottom 39 of the slot 38 and the bottom 45 of the turbine blade base 44, the space 48 being referred to herein as the root manifold. Spacer 14 has a flange 50 defining an annular face 52 which abuts the downstream face of the turbine wheel and the corresponding ends of the blades radially outboard of the root manifold 48. The volume between the turbine wheel 12 and the next succeeding turbine wheel and radially inboard of the spacer 14 is pressurized by relatively cool air from the compressor of the engine which circulates into the root manifold 48 through the downstream face of the turbine wheel inboard of the flange 50 and the annular face 52. From the root manifold the cooling air circulates through the internal passage of the blade and then into the motive fluid path 28. During passage through the turbine blade, the cooling air maintains the blade at a temperature consistent with maximum durability.

Between the upstream and downstream faces on both sides of the retention slots, air seals are established during wheel rotation at the lines of contact between the innermost lugs on the wheel and the innermost lugs on the blade bases. For example, during wheel rotation the lugs 42 on the blade base 44 engage corresponding ones of the lugs 40 on the wheel at lines of contact which intersect the upstream face 34 of the wheel and corresponding face of the blade base at a pair of spaced points 53, FIG. 2, which represent the radial outer extremity of the root manifolds. At the downstream face of the wheel an air seal is established at annular face 52 of the spacer 14. More particularly, the clamping force between the turbine wheel and the spacer presses the annular face 52 tightly against the downstream face. In addition, during engine operation each of the turbine blades of the stage is pushed rearwardly by aerodynamic pressure into intimate contact with annular face 52 of the spacer so that uniform alignment of the edges of the blade bases and downstream wheel face is achieved and a tight seal across the blade bases effected. An end seal according to this invention and designated generally 54 is located at the opposite ends of the root manifolds to prevent escape of cooling air at the upstream face 34 of the turbine wheel.

Figure 3:
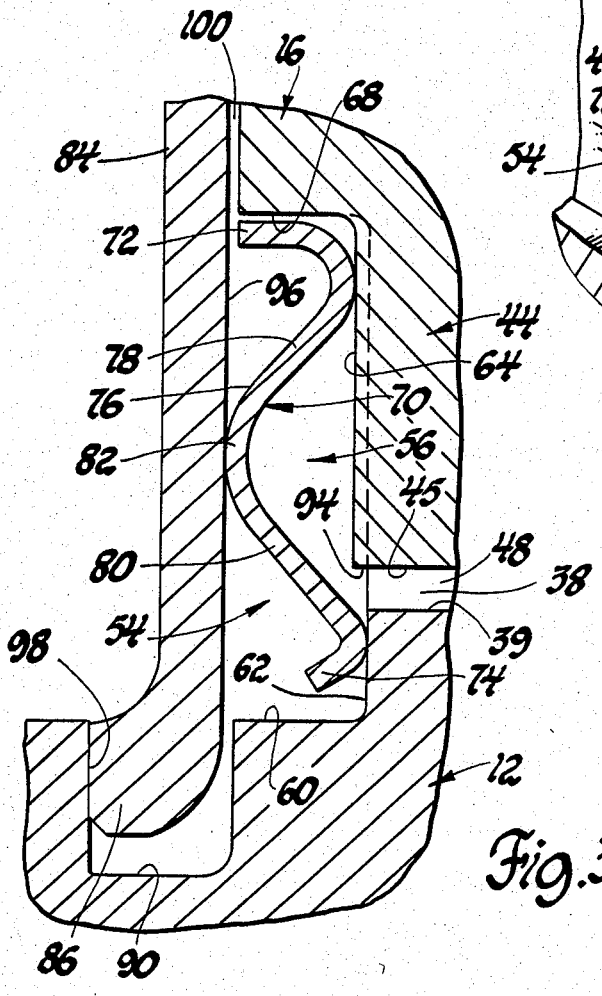
FIG. 3 is a sectional view taken generally along the plane indicated by lines 3—3 in FIG. 2.

With particular reference now to FIGS. 2 and 3, the end seal 54 includes an annular groove 56 in the upstream face 34 of the turbine wheel. The wheel groove 56 has a cylindrical outboard edge 58 at a predetermined radial distance from the axis of rotation of the turbine wheel corresponding to the radial outer extremities of the root manifolds as exemplified by points 53 representing the axial lines of contact between the lugs 40 and 42, a cylindrical inboard edge 60 at a radial distance from the axis of rotation of the turbine wheel less than the radial distance to the bottoms of the retention slots as represented by bottom 39 of slot 38, and a slot face 62 parallel to the upstream face 34 of the turbine wheel and extending between the inboard and outboard edges. Because the slot face 62 of the groove 56 spans a portion of each of the retention slots from below the slots to the outer extremities of the root manifolds, each of the turbine blades includes a recess exemplified by a vertical face 64 on blade 16 corresponding to the slot face 62 of the groove and a cylindrical face 68 on blade 16 corresponding to the outboard edge 58 of the groove. Accordingly, the groove 56 extends continuously through 360° around the axis of rotation of the rotor.

The end seal 54 further includes an imperforate seal ring 70 disposed in the groove 56. The seal ring 70 has a right cylindrical flange 72 disposed adjacent the continuous surface defined by the outboard edge 58 of the wheel groove and the cylindrical faces of the turbine blades, an annular foot 74, and an intermediate body portion 76 interconnecting the flange 72 and the foot 74. The body portion 76, in transverse cross section, FIG. 3, exhibits a single accordion fold configuration including an outboard leg 78 and an inboard leg 80 joined at a knee section 82. The seal ring 70 is fabricated from a metallic alloy selected to function in the turbine environment and to exhibit flexibility at the knee section 82.

Referring now to all of the Figures, the end seal 54 further includes a plurality of seal plate segments 84 each having an inner edge 86 and an outer edge 88. The inner edges 86 are received in a cylindrical groove 90 in the turbine wheel 12 extending radially inwardly of the inboard edge 60 of the groove 56. The outer edges 88 of the seal plates are received within a circumferential groove defined by a series of aligned grooves in each of the turbine blades of the stage, as for example a groove 92 in the platform 26 of the blade 16, FIG. 1. The seal plates cooperate to define a continuous 360° closure or cover over the groove 56 whereby the seal ring 70 is captured between the seal plates and the turbine wheel and blades.

Describing now the installation and operation of the end seal 54, with each of the turbine blades installed on the turbine wheel 12 and with the spacer 14 secured between the turbine wheel 12 and the next succeeding turbine wheel, each of the turbine blades is aligned with the downstream face of the wheel and seals against the annular face 52 of the spacer. Because of manufacturing tolerance it is not possible to assure that the opposite ends of each of the turbine blades adequately coincides with the upstream face 34 of the wheel to achieve a satisfactory seal merely by employing an axially clamped flange with an end surface corresponding to annular face 52 on the flange 50. Therefore, the blade bases are intentionally made slightly longer than the wheel lugs so that the vertical faces 64 project beyond the groove slot face 62 a distance shown in exaggerated fashion for clarity in FIG. 3 and designated 94. The spring action of the seal ring 70 forces the blades rearward into intimate contact with the spacer annular face 52 when the seal plate segments are installed. The diameter of the seal ring right circular flange 72 must be slightly less than the diameter of the outboard edge 58 of the wheel groove 56 to allow for ease of assembly. However, when the engine is operated, mechanical and thermal growth of the seal ring 70 causes it to expand radially outward and come tightly into contact with the outboard edge 58 of the wheel groove 56 and the blade cylindrical faces 68 effecting a tight seal. In addition, the annular foot 74 engages the slot face 62 of the groove 56 in a circle of contact extending 360° around the axis of rotation of the rotor at a radial distance therefrom less than the radial distance to the bottoms of the retention slots. In the free or unstressed condition, the axial height of the intermediate body portion 76 of the seal ring from the slot face 62 of groove 56 to the knee section 82 exceeds the depth of the groove 56 from the slot face 62 to back faces 96 of the seal plate segments 84 making it necessary to compress the seal ring 70 like a spring when seal plate segments 84 are installed.

Following installation of the seal ring, each of the seal plate segments 84 is conventionally installed in the cylindrical groove 90 in the turbine wheel and the corresponding grooves 92 in the turbine blades. While clearances between the various components have been exaggerated for clarity in FIG. 3, the seal plate segments 84 align themselves against the upstream face 98 of the turbine wheel cylindrical groove 90 with sufficient clearance at 100 for turbine blades having allowable manufacturing tolerances. In the installed positions of the seal plate segments, each engages the seal ring 70 at the knee section 82 and compresses the latter in a fashion tending to flatten the intermediate body portion 76 by spreading the outboard and inboard legs 78 and 80. In so doing the inboard leg 80 is resiliently flexed to bias the foot 74 tightly against the slot face 62 of the groove 56 radially inboard of the bottoms of the retention slots.

When the engine is ignited motive fluid is directed through the nozzle 18 to rotate the turbine wheel 12 at high speed while simultaneously heating the turbine blades and turbine wheel to temperatures significantly exceeding ambient. The seal ring 70, being heated with the wheel and blades, experiences thermal growth relative to the turbine wheel whereby the right circular flange 72 expands against outboard edge 58 of the groove 56 and corresponding ones of the cylindrical faces 68 of the turbine blades. In addition, the high rate of rotation of the turbine wheel causes the right circular flange 72 to be centrifugally thrust against the outboard edge 58 and the cylindrical faces 68 thereby effecting a tight seal across the right circular flange. Because the outboard edge 58 and corresponding cylindrical faces 68 are aligned with the lines of contact between lugs 42 on the representative blade 16 and the lugs 40 on the wheel, a substantially airtight outboard end seal is defined outboard of each of the root manifolds. In addition, the very high rotative speed of the turbine wheel 12 develops centrifugal forces on the inboard leg 80 of the intermediate body portion 76 of the seal ring 70 which urge the accordion fold of the intermediate body portion toward a fully collapsed or folded condition. The seal plate segments 84, however, cooperate with the slot face 62 of the groove 56 in preventing collapse of the inboard leg 80. The result is that the inboard leg 80 is centrifugally thrust or wedged against both the seal plate segments 84 and the slot face 62 of the groove 56 so that the foot 74 is more tightly thrust against the slot face 62. Accordingly, an airtight seal is established through 360° around the axis of rotation of the turbine wheel at the circle of contact between the foot 74 and the slot face 62 whereby an inboard seal for each of the root manifolds is established.

The embodiments of the invention in which an exclusive property or privilege is claimed are defined as follows:

1. In a gas turbine engine rotor including a wheel rotatable about an axis of said engine with an upstream face and a downstream face in planes perpendicular to said axis and a plurality of circumferentially arrayed retention slots between said faces with lugs on opposite sides of said slots, a plurality of blades each having a base with lugs thereon slidably disposed in a corresponding one of said slots and defining therewith a root manifold with said base lugs engaging said slot lugs for blade retention and for defining seals on opposite sides of said root manifolds at predetermined radii from said engine axis, and means for directing pressurized air to each of said root manifolds through one of said upstream and said downstream faces, an end seal comprising, means on said wheel and on each of said blades defining an annular groove in the other of said upstream and said downstream faces traversing each of said bases and including a cylindrical outboard edge at a radius from said engine axis generally equal to said predetermined radius and a cylindrical inboard edge inboard of each of said slots and an annular slot face parallel to said other face, an annular imperforate seal ring in said groove having a right cylindrical flange adjacent said outboard edge and a foot engaging said slot face in a circle of contact inboard of each of said slots, said flange being centrifugally thrust against said outboard edge during rotation of said wheel to effect a 360° seal around said wheel outboard of each of said root manifolds, and means biasing said foot against said slot face during rotation of said wheel to effect a 360° seal around said wheel inboard of each of said root manifolds.

2. In a gas turbine engine rotor including a wheel rotatable about an axis of said engine with an upstream face and a downstream face in planes perpendicular to said axis and a plurality of circumferentially arrayed retention slots extending between said faces with lugs on opposite sides of said slots, a plurality of blades each having a base with lugs thereon slidably disposed in a corresponding one of said slots and defining therewith a root manifold with said base lugs engaging said slot lugs for blade retention and for defining seals on opposite sides of said root manifolds at predetermined radii from said engine axis, and means for directing pressurized air to each of said root manifolds through one of said upstream and said downstream faces, an end seal comprising, means on said wheel and on each of said blades defining an annular groove in the other of said upstream and said downstream faces traversing each of said bases and including a cylindrical outboard edge at a radius from said engine axis generally equal to said predetermined radius and a cylindrical inboard edge inboard of each of said slots and an annular slot face parallel to said other face, seal plate means on said wheel defining an annular cover over said groove, an annular imperforate seal ring in said groove having a right cylindrical flange adjacent said outboard edge and an annular foot engaging said slot face in a circle of contact inboard of each of said slots, said flange being centrifugally thrust against said outboard edge during rotation of said wheel to effect a 360° seal around said wheel outboard of each of said root manifolds, spring means between said foot and said seal plate means biasing said foot against said slot face, and means on said seal ring operative to centrifugally thrust said foot against said slot face during rotation of said wheel to supplement said spring means in urging said foot against said slot face to effect a 360° end seal around said wheel inboard of each of said root manifolds.

3. In a gas turbine engine rotor including a wheel rotatable about an axis of said engine with an upstream face and a downstream face in planes perpendicular to said axis and a plurality of circumferentially arrayed retention slots extending between said faces with lugs on opposite sides of said slots, a plurality of blades each having a base with lugs thereon slidably disposed in a corresponding one of said slots and defining therewith a root manifold with said base lugs engaging said slot lugs for blade retention and for defining seals on opposite sides of said root manifolds at predetermined radii from said engine axis, and means for directing pressurized air to each of said root manifolds through said downstream face, an end seal comprising, means on said wheel and on each of said blades defining an annular groove in said upstream face traversing each of said bases and including a cylindrical outboard edge at a radius from said engine axis generally equal to said predetermined radius and a cylindrical inboard edge inboard of each of said slots and an annular slot face parallel to said upstream face, an imperforate seal ring including a body portion having an inner leg with an annular foot and an outer leg interconnected at an integral knee section to define an accordion fold in transverse cross section and a right cylindrical flange integral with said outer leg, said seal ring being disposed in said annular groove with said cylindrical flange adjacent said outboard edge and with said annular foot engaging said slot face in a circle of contact inboard of each of said slots and said accordion fold having a free height exceeding the depth of said annular groove so that said knee section projects beyond said upstream face, means on said wheel defining an inner circumferential groove adjacent said upstream face and inboard of said annular groove inboard edge, means on each of said blades defining an outer circumferential groove adjacent said upstream face and outboard of said annular groove outboard edge, and a plurality of seal plate segments disposed on said wheel and captured between said inner and said outer circumferential grooves generally in the plane of said upstream face thereby to define an annular cover over said annular groove, said seal plate segments engaging said seal ring at said knee section to expand said accordion fold and thereby bias said foot against said annular groove slot face while said accordion fold is centrifugally urged toward a folded condition during rotation of said wheel to centrifugally thrust said foot against said slot face to effect a 360° seal around said wheel inboard of each of said root manifolds, said right cylindrical flange being centrifugally thrust against said outboard edge during rotation of said wheel to effect a 360° seal around said wheel outboard of each of said root manifolds.

* * * * *